United States Patent [19]

Zaghloul

[11] Patent Number: 4,761,654

[45] Date of Patent: Aug. 2, 1988

[54] ELECTROMAGNETICALLY COUPLED MICROSTRIP ANTENNAS HAVING FEEDING PATCHES CAPACITIVELY COUPLED TO FEEDLINES

[75] Inventor: Amir I. Zaghloul, Bethesda, Md.

[73] Assignee: Communications Satellite Corporation, Washington, D.C.

[21] Appl. No.: 748,637

[22] Filed: Jun. 25, 1985

[51] Int. Cl.[4] ..... H01Q 0/0

[52] U.S. Cl. ..... 343/700 MS

[58] Field of Search ..... 343/700 MS, 846

[56] References Cited

U.S. PATENT DOCUMENTS 4,477,813 10/1984 Weiss ..... 343/700 MS
4,554,549 11/1985 Fassett et al. ..... 343/700 MS
4,623,893 11/1986 Sabban ..... 343/700 MS

FOREIGN PATENT DOCUMENTS 0134804 10/1981 Japan ..... 343/700 MS
0181706 10/1984 Japan ..... 343/700 MS
2046530 11/1980 United Kingdom .

OTHER PUBLICATIONS

Haneishi et al.; Electronic Letters, Mar. 4, 1982, vol. 18, No. 5, pp. 191, 192, 193.

*Primary Examiner*—William L. Sikes
*Assistant Examiner*—Robert E. Wise
*Attorney, Agent, or Firm*—Sughrue, Mion, Zinn, Macpeak and Seas

[57] ABSTRACT

A microstrip antenna array having broadband linear polarization, and circular polarization with high polarization purity, feedlines of the array being capacitively coupled to feeding patches at a single feedpoint or at multiple feedpoints, the feeding patches in turn being electromagnetically coupled to corresponding radiating patches. The contactless coupling enables simple, inexpensive multilayer manufacture.

23 Claims, 5 Drawing Sheets

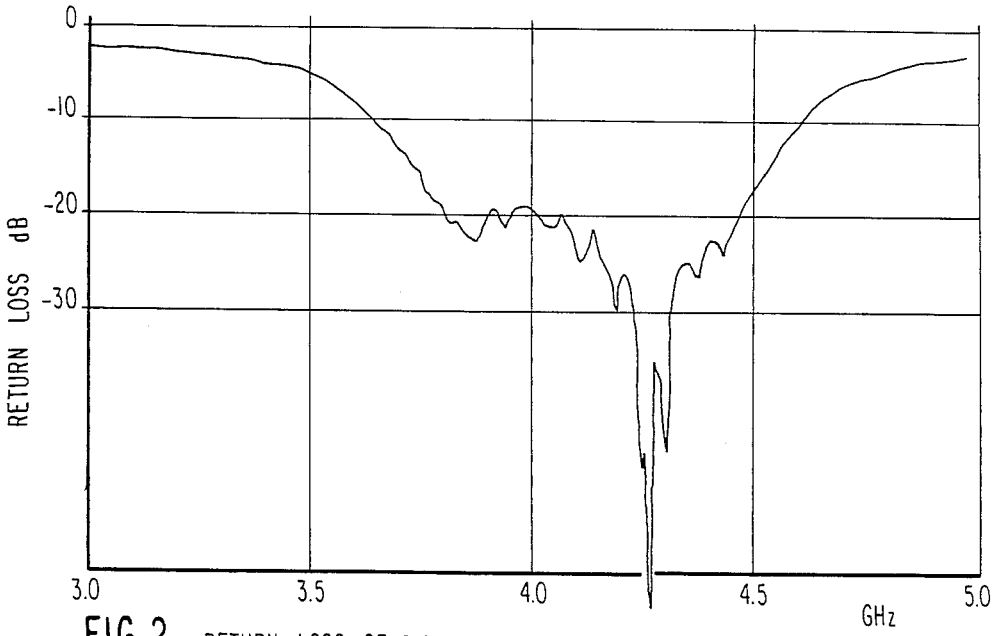
FIG. 2 _ RETURN LOSS OF OPTIMIZED LINEARLY POLARIZED CF-EMCP ELEMENT
FIG. 3a _ CONFIGURATION OF CIRCULARLY POLARIZED CF-EMCP ELEMENT WITH NEGATIVE SEGMENTS (NOTCHES)
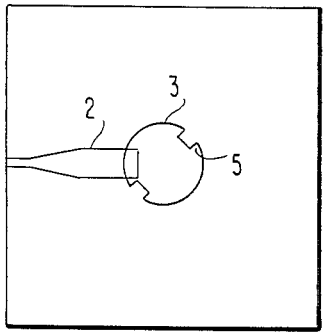
FIG. 3b _ CONFIGURATION OF CIRCULARLY POLARIZED CF-EMCP ELEMENT WITH POSITIVE SEGMENTS (TABS)
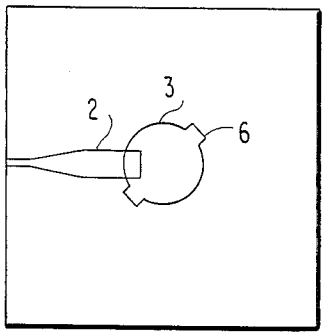

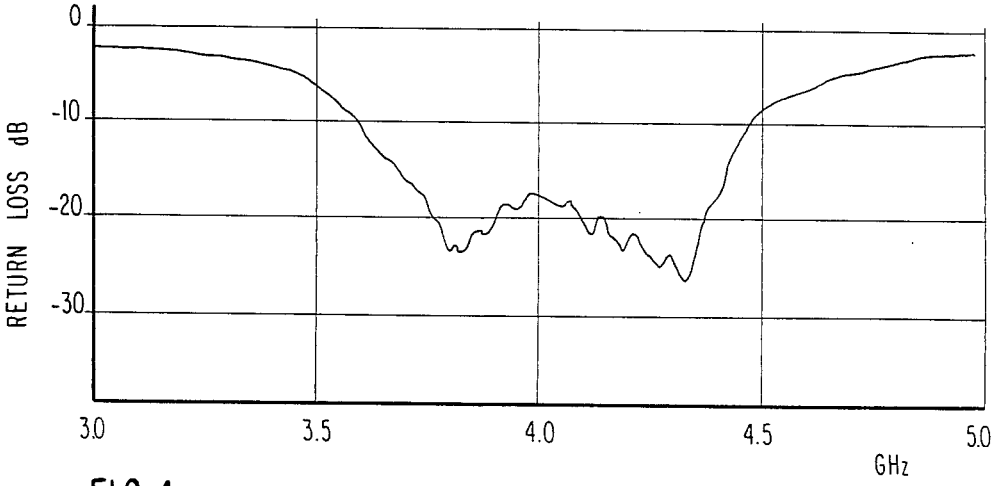
FIG. 4 _ RETURN LOSS OF OPTIMIZED CIRCULARLY POLARIZED CF-EMCP ELEMENT
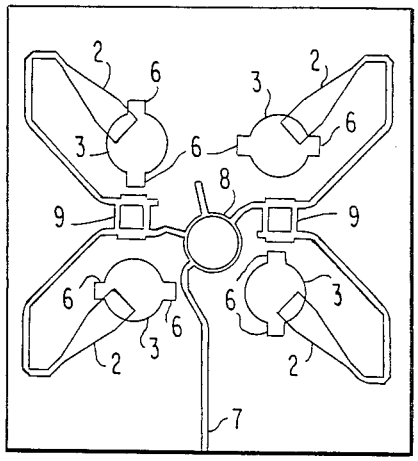
FIG. 5 _ CONFIGURATION FOR WIDE-BAND 4-ELEMENT CIRCULARLY POLARIZED CF-EMCP ARRAY

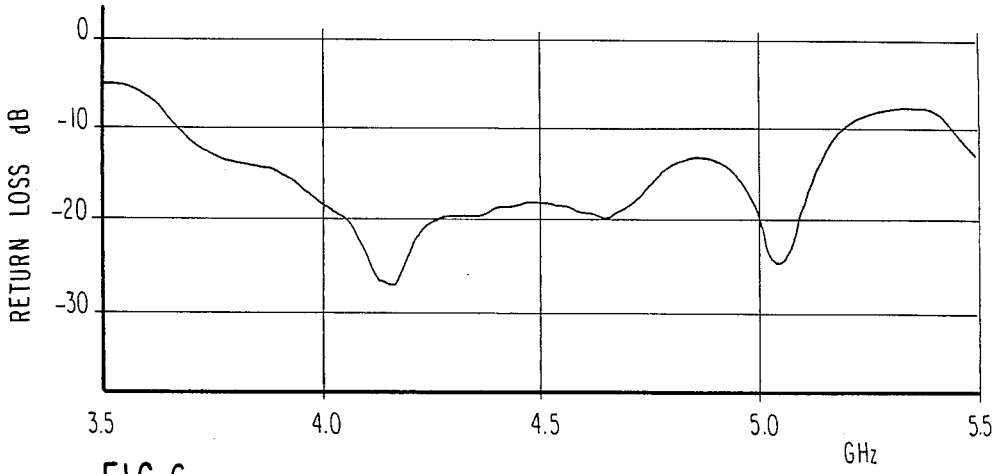
FIG. 6 _ RETURN LOSS OF 4-ELEMENT CIRCULARLY POLARIZED CF-EMCP
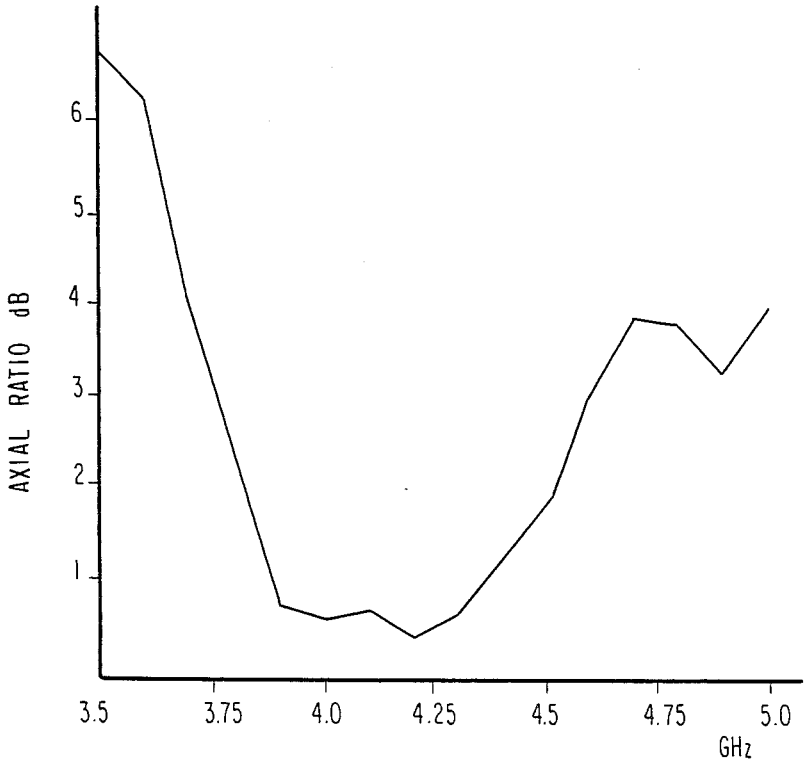
FIG. 7 _ AXIAL RATIO OF 4-ELEMENT ARRAY

ELECTROMAGNETICALLY COUPLED MICROSTRIP ANTENNAS HAVING FEEDING PATCHES CAPACITIVELY COUPLED TO FEEDLINES

BACKGROUND OF THE INVENTION

The present invention relates to an electromagnetically coupled microstrip patch (EMCP) antenna element whose feeding patch is capacitively coupled to a feedline. The feeding patch is electromagnetically coupled to a radiating patch. A plurality of such antennas may be combined to make an antenna array.

Microstrip antennas have been used for years as compact radiators. However, they have suffered from a number of deficiencies. For example, they are generally inefficient radiators of electromagnetic radiation; they operate over a narrow bandwidth; and they have required complicated connection techniques to achieve linear and circular polarization, so that fabrication has been difficult.

Some of the above-mentioned problems have been solved. U.S. Pat. No. 3,803,623 discloses a means for making microstrip antennas more efficient radiators of electromagnetic radiation. U.S. Pat. No. 3,987,455 discloses a multiple-element microstrip antenna array having a broad operational bandwidth. U.S. Pat. No. 4,067,016 discloses a circularly polarized microstrip antenna.

The antennas described in the above-mentioned patents still suffer from several deficiencies. They all teach feeding patches directly connected to a feedline.

U.S. Pat. Nos. 4,125,837, 4,125,838, 4,125,839, and 4,316,194 show microstrip antennas in which two feedpoints are employed to achieve circular polarization. Each element of the array has a discontinuity, so that the element has an irregular shape. Consequently, circular polarization at a low axial ratio is achieved. Each element is individually directly coupled via a coaxial feedline.

While the patents mentioned so far have solved a number of problems inherent in microstrip antenna technology, other difficulties have been encountered. For example, while circular polarization has been achieved, two feedpoints are required, and the antenna elements must be directly connected to a feedline. U.S. Pat. No. 4,477,813 discloses a microstrip antenna system with a nonconductively coupled feedline. However, circular polarization is not achieved.

Copending application Ser. No. 623,877, filed June 25, 1984 and commonly assigned with the present application, discloses a broadband circular polarization technique for a microstrip array antenna. While the invention disclosed in this copending application achieves broadband circular polarization, the use of capacitive coupling between the feedline and feeding patch and the use of electromagnetic coupling between the feeding patch and radiating patch is not disclosed.

With the advent of certain technologies, e.g. microwave integrated circuits (MIC,) monolithic microwave integrated circuits (MMIC,) and direct broadcast satellites (DBS,) a need for inexpensive, easily-fabricated antennas operating over a wide bandwidth has arisen. This need also exists for antenna designs capable of operating in different frequency bands. While all of the patents discussed have solved some of the technical problems individually, none has yet provided a microstrip antenna having all of the features necessary for practical applications in certain technologies.

SUMMARY OF THE INVENTION

Accordingly, it is one object of the present invention to provide a microstrip antenna which is capable of operating over a wide bandwidth, in either linear or circular polarization mode, yet which is simple and inexpensive to manufacture.

It is another object of this invention to provide a microstrip antenna and its feed network made of multiple layers of printed boards which do not electrically contact each other directly, wherein electromagnetic coupling between the boards is provided.

It is another object of the invention to provide a microstrip antenna having a plurality of radiating elements, each radiating patch being electromagnetically coupled to a feeding patch which is capacitively coupled at a single feedpoint, or at multiple feedpoints, to a feedline.

It is yet another object of the invention to provide a microstrip antenna having circularly polarized elements, and having a low axial ratio.

Still another object of the invention is to provide a microstrip antenna having linearly polarized elements, and having a high axial ratio.

To achieve these and other objects, the present invention has a plurality of radiating and feeding patches, each having perturbation segments, the feeding patches being electromagnetically coupled to the radiating patches, the feedline being capacitively coupled to the feeding patch. (To achieve linear polarization, the perturbation segments are not required.)

The feed network also can comprise active circuit components implemented using MIC or MMIC techniques, such as amplifiers and phase shifters to control the power distribution, the sidelobe levels, and the beam direction of the antenna.

The design described in this application can be scaled to operate in any frequency band, such as L-band, S-band, X-band, $K_u$-band, or $K_a$-band.

BRIEF DESCRIPTION OF THE DRAWINGS

The invention will be described below with reference to the accompanying drawings, in which:

FIG. 2 is a graph of the return loss of the optimized linearly polarized capacitively fed electromagnetically coupled patch element of FIG. 1(*a*);

FIGS. 3(*a*) and 3(*b*) are schematic diagrams showing the configuration of a circularly polarized capacitively fed electromagnetically coupled patch element, both layers of patches containing perturbation segments;

FIG. 4 is a graph of the return loss of the element shown in FIG. 3(*b*);

FIG. 5 is a plan view of a four-element microstrip antenna array having a wide bandwidth and circularly polarized elements;

FIG. 6 is a graph showing the return loss of the array shown in FIG. 5;

FIG. 7 is a graph showing the on-axis axial ratio of the array shown in FIG. 5.

DETAILED DESCRIPTION OF THE PREFERRED EMBODIMENT

Figure 1A:
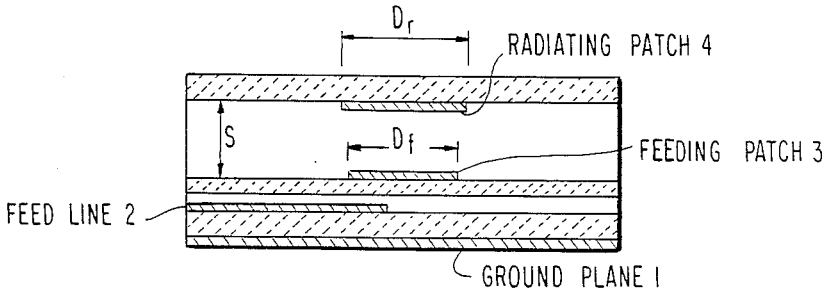
FIGS. 1(*a*) and 1(*b*) show cross-sectional views of a capacitively fed electromagnetically coupled linearly-polarized patch antenna element for a microstrip feedline and a stripline feedline, respectively, and FIG. 1(*c*) shows a top view of the patch antenna element of FIG. 1(*a*), with feedline 2' shown as a possible way of achieving circular polarization when feedlines 2 and 2' are in phase quadrature.
Figure 1B:
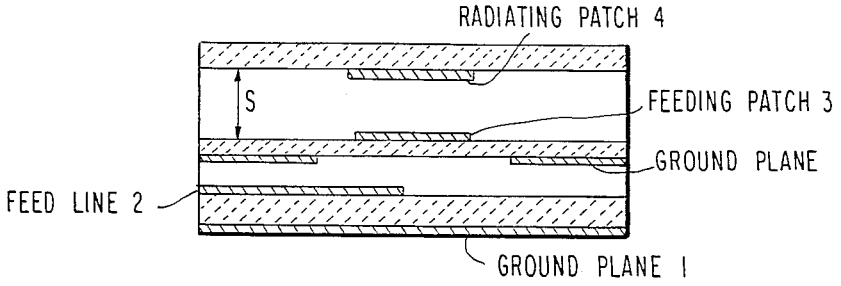
Figure 1C:
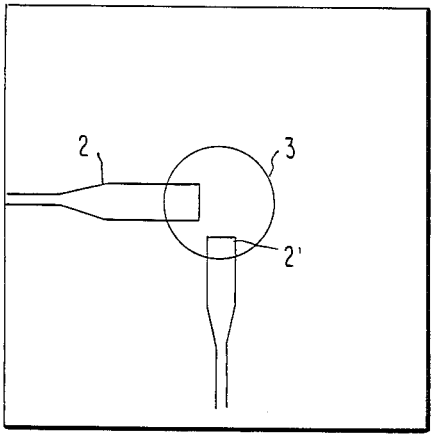

Referring to FIGS. 1(*a*), 1(*b*), and 1(*c*), a 50-ohm feedline 2 is truncated, tapered, or changed in shape in order to match the feedline to the microstrip antenna, and is capacitively coupled to a feeding patch 3, the feedline being disposed between the feeding patch and a ground plane 1. The feedline is implemented with microstrip, suspended substrate, stripline, finline, or coplanar waveguide technologies.

The feedline and the feeding patch do not come into contact with each other. They are separated by a dielectric material, or by air. The feeding patch in turn is electromagnetically coupled to a radiating patch 4, the feeding patch and the radiating patch being separated by a distance S. Again, a dielectric material or air may separate the feeding patch and the radiating patch. The feedline must be spaced an appropriate fraction of a wavelength λ of electromagnetic radiation from the feeding patch. Similarly, the distance S between the feeding patch and the radiating patch must be determined in accordance with the wavelength λ.

While the feeding patches and radiating patches in the Figures are circular, they may have any arbitrary but predefined shape.

FIG. 2 shows the return loss of an optimized linearly polarized, capacitively fed, electromagnetically coupled patch antenna of the type shown in FIG. 1(*a*) It should be noted that a return loss of more than 20 dB is present on either side of a center frequency of 4.1 GHz.

FIG. 3(*a*) shows the feedline capacitively coupled to a feeding patch having diametrically opposed notches 4 cut out, the notches being at a 45 degree angle relative to the capacitive feedline coupling. Because the feedline may be tapered, i.e. it becomes wider as it approaches the feeding patch to minimize resistance, sufficient space for only one feedpoint per feeding patch may be available. Consequently, in order to achieve circular polarization, the perturbation segments—either the notches shown in FIG. 3(*a*), or the tabs 5 shown in FIG. 3(*b*), the tabs being positioned in the same manner as the notches relative to the feedline—are necessary. Two diametrically opposed perturbation segments are provided for each patch. Other shapes and locations of perturbation segments are possible. For the case where two feedpoints are possible, i.e. where sufficient space exists, perturbation segments may not be required. Such a configuration is shown in FIG. 1(*c*), in which feedlines 2 and 2′ are placed orthogonal to each other with 90 degree phase shift in order to achieve circular polarization.

FIG. 4 shows the return loss of an optimized circularly polarized, capacitively fed, electromagnetically coupled patch antenna of the type shown in FIG. 3(*b*). Note that a return loss of more than 20 dB is present on either side of a center frequency of 4.1 GHz.

In FIG. 5, a plurality of elements making up an array are shown. The perturbation segments on each element are oriented differently with respect to the segment positionings on the other elements, though each feedline is positioned at the above-mentioned 45 degree orientation with respect to each diametrically-opposed pair of segments on each feeding patch. The line 6 feeds to a ring hybrid 7 which feeds two branch-line couplers 8 on a feed network board. This results in the feedlines 2 being at progressive 90 degree phase shifts from each other. Other feed networks producing the proper power division and phase progression can be used.

The feeding patches are disposed such that they are in alignment with radiating patches (not numbered). That is, for any given pair comprising a feeding patch and a radiating patch, the tabs (or notches) are in register. The pairs are arranged such that the polarization of any two adjacent pairs is orthogonal. In other words, the perturbation segments of a feeding patch will be orthogonal with respect to the feeding patches adjacent thereto. Individual feedlines radiate to the feeding patches. As a result, the overall array may comprise three boards which do not contact each other: a feed network board; a feeding patch board; and a radiating patch board.

In addition, while FIG. 5 shows a four-element array, any number of elements may be used to make an array, in order to obtain performance over a wider bandwidth. Of course, the perturbation segments must be positioned appropriately with respect to each other; for the four-element configuration, these segments are positioned orthogonally.

Figure 8:
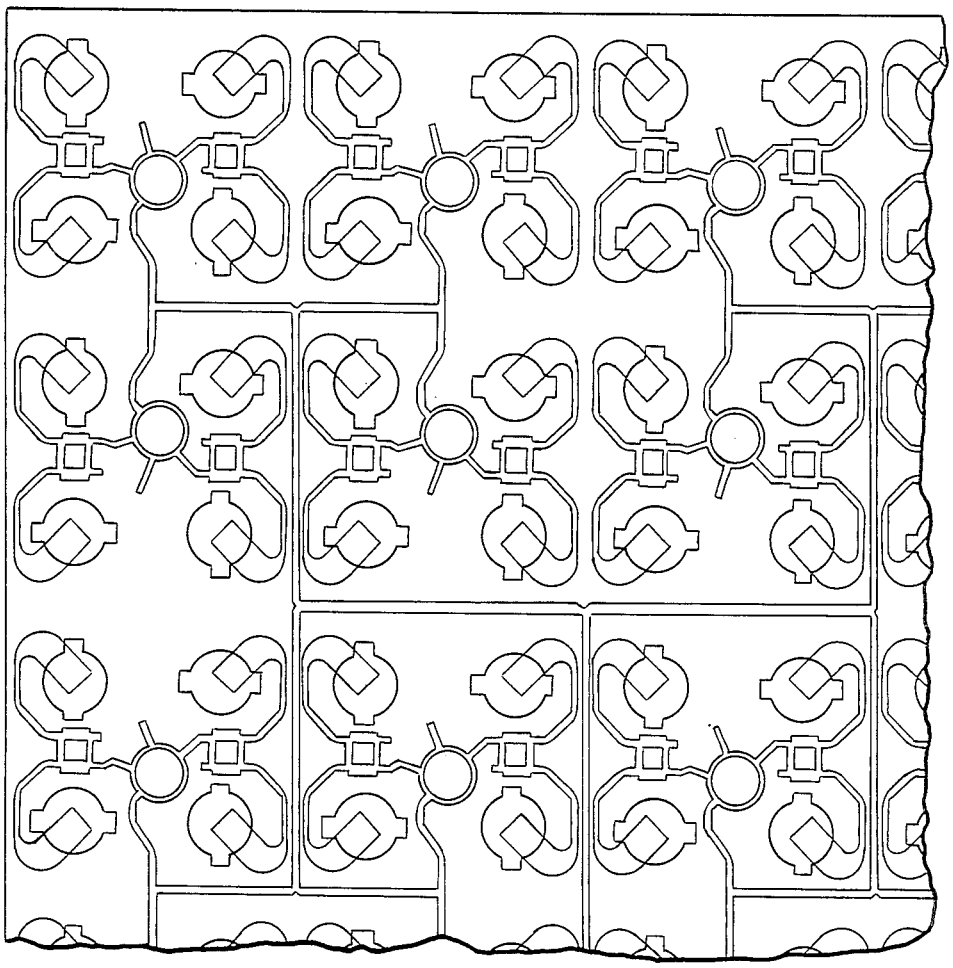
FIG. 8 is a plan view of a microstrip antenna array in which a plurality of subarrays configured in a manner similar to the configuration shown in FIG. 5 are used.

Further, a plurality of arrays having configurations similar to that shown in FIG. 5 may be combined to form an array as shown in FIG. 8. (In this case, the FIG. 5 arrays may be thought of as subarrays.) Each subarray may have a different number of elements. If circular polarization is desired, of course, the perturbation segments on the elements in each subarray must be positioned appropriately within the subarray, as described above with respect to FIG. 5. In particular, the perturbation segments should be positioned at regular angular intervals within each subarray, such that the sum of the angular increments (phase shifts) between elements in each subarray is 360 degrees. In other words, the angular increment between the respective adjacent elements is 360/N, where N is the number of elements in a given subarray.

Another parameter which may be varied is the size of the tabs or notches used as perturbation segments in relation to the length and width of the feeding and radiating patches. The size of the segments affects the extent and quality of circular polarization achieved.

FIG. 6 shows the return loss for a four-element microstrip antenna array fabricated according to the invention, and similar to the antenna array shown in FIG. 5. As can be seen, the overall return loss is close to 20 dB over 750 MHz, or about 18% bandwidth.

FIG. 7 shows the axial ratio, which is the ratio of the major axis to the minor axis of polarization, for an optimal perturbation segment size. The axial ratio is less than 1 dB over 475 MHz, or about 12% bandwidth. The size of the perturbation segments may be varied to obtain different axial ratios.

The overall technique described above enables inexpensive, simple manufacture of microstrip antenna arrays whose elements are linearly polarized or circularly polarized, which have high polarization purity, and which perform well over a wide bandwidth. All these features make a microstrip antenna manufactured according to the present invention attractive for use in MIC, MMIC, DBS, and other applications, as well as in other applications employing different frequency bands.

Although the invention has been described in terms of employing two layers of patches for wideband applications, a multiplicity of layers can be used. All the layers are electromagnetically coupled, and can be designed with different sets of dimensions to produce either wideband operation or multiple frequency operation.

Although the invention has been described and shown in terms of preferred embodiments thereof and possible applications therefor, it will be understood by those skilled in the art that changes in form and detail may be made therein without departing from the spirit and scope of the invention as defined in the appended claims.

What is claimed is:

1. A method of fabricating microstrip antennas. comprising:

providing a feed network board having a plurality of feedlines which are wider at one end than at the other, for impedance matching with other microstrip antenna elements;

providing a feeding patch board having a plurality of feeding patches which are impedance matched with the wider end of said feedlines;

providing a radiating patch board having a plurality of radiating patches which are impedance matched with said feeding patches and said feedlines;

coupling in a contactless manner said feed network board to said feeding patch board wherein each of said feeding patches is coupled to at least a corresponding one of said feedlines; and coupling said feeding patch board in a contactless manner to said radiating patch board.

2. A method according to claim 1, wherein each of said plurality of feedlines, said plurality of feeding patches, and said radiating patches is separated into at least two groups, each group of tapered, feeding patches, and radiating patches forming a subarray, wherein at least two subarrays are formed, the subarrays being connected to a common feedline.

3. A method according to claim 1, wherein said plurality of feedlines, said plurality of feeding patches, and said plurality of radiating patches are configured so as to achieve linear polarization.

4. A method according to claim 1, wherein each of said plurality of feeding patches has a plurality of first perturbation segments, and each of said plurality of radiating patches has a plurality of second perturbation segments, said method further comprising the step of coupling each of said feeding patches and a respective one of said radiating patches such that said first and second perturbation segments on each of said feeding patches and a respective one of said radiating patches are in register, wherein circular polarization is achieved.

5. A method according to claim 1, wherein each of said plurality of feeding patches is coupled to at least two feedlines to enable circular polarization.

6. A microstrip antenna, comprising:

a plurality of feedlines which are wider at one end than at the other;

a plurality of feeding patches, each coupled in a contactless manner to at least a respective one of said plurality of feedlines at the wider end thereof, said feeding patches being imedance matched with the wider end of said feedlines; and a plurality of radiating patches, each coupled in a contactless manner to a respective one of said plurality of feeding patches, wherein said feedlines are capacitively coupled to said feeding patches and said feeding patches are capacitively coupled to said radiating patches.

7. A microstrip antenna according to claim 6, wherein each of said plurality of feedlines, said plurality of feeding patches, and said plurality of radiating patches is separated into at least two groups so as to form at least two subarrays, each group of feedlines, feeding patches, and radiating patches forming a subarray, the subarrays being connected to a common feedline.

8. A microstrip antenna according to claim 7, wherein said plurality of feeding patches has a plurality of first perturbation segments and said plurality of radiating patches has a plurality of second perturbation segments so as to achieve circular polarization.

9. A microstrip antenna array according to claim 8 wherein said first and second perturbation segments comprise tabs extending from said feeding patches and said radiating patches, respectively.

10. A microstrip antenna array according to claim 8, wherein said first and second perturbation segments comprise notches cut out from said feeding patches and said radiating patches, respectively.

11. A microstrip antenna array according to claim 8, wherein the number of elements in a first one of said at least two groups is $N_1$ and the number of elements in a second one of said at least two groups is $N_2$, where $N_1$ and $N_2$ are integers greater than 1.

12. A microstrip antenna array according to claim 11, wherein a first angular displacement of the perturbation segments of one radiation patch relative to the perturbation segments on adjacent radiating patches within said first one of said at least two groups is equal to 360 degrees divided by $N_1$, and a second angular displacement of the perturbation segments of one radiating patch relative to the perturbation segments on adjacent radiating patches within said second one of said at least two groups is equal to 360 degrees divided by $N_2$.

13. A microstrip antenna array according to claim 8, wherein the number of said plurality of first perturbation segments is two, said first perturbation segments being diametrically opposed with respect to each other on each of said feeding patches.

14. A microstrip antenna array according to claim 13, wherein each of said feedlines is coupled to a corresponding one of said feeding patches at an angle of 45 degrees with respect to one of said first perturbation segments.

15. A microstrip antenna array according to claim 14, wherein the number of said second perturbation segments is two, and wherein said first and second perturbation segments on each of said feeding patches and a respective one of said radiating patches are in register.

16. A microstrip antenna according to claim 7, wherein said plurality of feedlines are connected to a common feedline.

17. A microstrip antenna according to claim 6, wherein each of said plurality of feeding patches is coupled to one of said feedlines so as to achieve linear polarization.

18. A microstrip antenna according to claim 6, wherein each of said plurality of feeding patches is coupled to at least one of said feedlines, whereby circular polarization is achieved.

19. A microstrip antenna according to claim 6, wherein said feeding patches and said radiating patches are circularly-shaped.

20. A microstrip antenna according to claim 6, wherein each of said feedlines is separated from a corresponding one of said feeding patches by a dielectric material.

21. A microstrip antenna according to claim 6, wherein each of said feedlines is separated from a corresponding one of said feeding patches by air.

22. A microstrip antenna according to claim 6, wherein each of said feeding patches is separted from a corresponding one of said radiating patches by a dielectric material.

23. A microstrip antenna according to claim 6, wherein each of said feeding patches is separated from a corresponding one of said radiating patches by air.

* * * * *

UNITED STATES PATENT AND TRADEMARK OFFICE

CERTIFICATE OF CORRECTION

PATENT NO. : 4,761,654

DATED : August 2, 1988

INVENTOR(S) : Zagloul

It is certified that error appears in the above-identified patent and that said Letters Patent is hereby corrected as shown below:

COLUMN 5, LINE 35 Delete "tapered" insert --feedlines--;

COLUMN 5, LINE 63 Delete "imedance" insert --impedance--;

Signed and Sealed this

Twenty-first Day of February, 1989

*Attest:*

DONALD J. QUIGG

*Attesting Officer*

*Commissioner of Patents and Trademarks*

UNITED STATES PATENT AND TRADEMARK OFFICE
CERTIFICATE OF CORRECTION

PATENT NO. : 4,761,654

DATED : August 2, 1988

INVENTOR(S) : Amir Ibrahim ZAGHLOUL

It is certified that error appears in the above-identified patent and that said Letters Patent is hereby corrected as shown below:

| | |
|---|---|
| CLAIM 9, LINE 1 | Delete "array". |
| CLAIM 10, LINE 1 | Delete "array". |
| CLAIM 11, LINE 1 | Delete "array". |
| CLAIM 12, LINE 1 | Delete "array". |
| CLAIM 13, LINE 1 | Delete "array". |
| CLAIM 14, LINE 1 | Delete "array". |
| CLAIM 15, LINE 1 | Delete "array". |

Signed and Sealed this

Fifth Day of September, 1989

*Attest:*

*Attesting Officer*

DONALD J. QUIGG

*Commissioner of Patents and Trademarks*